United States Patent [19]

Krieger et al.

[11] Patent Number: 4,465,408

[45] Date of Patent: Aug. 14, 1984

[54] MINE-ROOF SUPPORT CONTROL MECHANISM

[75] Inventors: Karl Krieger, Wuppertal; Günter Kuschke, Castrop-Rauxel; Werner Reinelt, Bochum, all of Fed. Rep. of Germany

[73] Assignee: Hermann Hemscheidt Maschinenfabrik GmbH & Co., Wuppertal, Fed. Rep. of Germany

[21] Appl. No.: 490,529

[22] Filed: Apr. 29, 1983

[30] Foreign Application Priority Data

May 8, 1982 [DE] Fed. Rep. of Germany ..... 3217391
Feb. 12, 1983 [DE] Fed. Rep. of Germany ..... 3304982

[51] Int. Cl.³ ..... E21D 23/16

[52] U.S. Cl. ..... 405/302; 91/170 MP; 405/293

[58] Field of Search ..... 405/302, 293, 294, 296; 91/170 MP, 522, 527; 299/31, 33

[56] References Cited

U.S. PATENT DOCUMENTS 4,427,321 1/1984 Weirich et al. ..... 405/302 X

FOREIGN PATENT DOCUMENTS 2921926 12/1980 Fed. Rep. of Germany ..... 405/302
3000866 7/1981 Fed. Rep. of Germany ..... 405/302
3015411 11/1981 Fed. Rep. of Germany ..... 405/302
2101662 1/1983 United Kingdom ..... 405/302

*Primary Examiner*—Dennis L. Taylor
*Attorney, Agent, or Firm*—Berman, Aisenberg & Platt

[57] ABSTRACT

A control line connects an annular space in an auxiliary hydraulic cylinder of an hydraulically-movable mine-roof support (the auxiliary cylinder being provided to advance a forward, auxiliary, roof-support canopy in the direction of the working face of a mine) to the displacement space of an hydraulic measuring cylinder which is longitudinally displaceable in a direction parallel to the hydraulic advancing cylinder in order to advance the auxiliary roof-support canopy, which is pivoted to the main roof-support canopy, in synchronism with the advancing cylinder mounted in the base of the mine-roof support and attached to an abutment on the working face side of the support. A control valve is connected to the control line and responds to the control line pressure in such a way that, when the pressure falls, it supplies pressurized fluid into the pressure space of the auxiliary cylinder to extend the piston rod thereof, and shuts off again when the pressure increases. An axial bore in the piston rod of the advancing cylinder preferably serves as the measuring cylinder.

14 Claims, 4 Drawing Figures

MINE-ROOF SUPPORT CONTROL MECHANISM

This invention relates to an hydraulic control mechanism for use in an hydraulically-movable mine-roof support having a forward auxiliary, roof-support canopy which is pivoted to the main roof-support canopy and which can be extended in synchronism with the longitudinal extension of the advancing cylinder of the mine-roof support in the direction of the working face of the mine.

Control mechanisms for hydraulically-advancing mine-roof supports are already known for the automatic control of the advance of an auxiliary roof-support canopy in such a manner that the roof exposed by the mineral winning machine is reinforced in synchronism with the inroads progressively made in the mineral at the working face. The auxiliary support canopy must support the roof without any delay—even before the mine-roof support is moved—so that the roof is not left unsupported for any length of time. In this way falls are avoided during exploitation of the mineral at the working face and, more especially, in shearer-type mining operations in which the roof is exposed in sections.

German Patent Specification No. 30 00 866 discloses the controlling of the synchronous movement of the auxiliary roof-support cylinder and of the advancing cylinder with a control fluid. When the advancing cylinder is in its retracted position, a column of liquid is contained in an annular space inside the piston rod and, during the extending movement of the advancing cylinder, is expelled into a control cylinder by an auxiliary piston rod. An actuating piston pressurised by the control fluid in the control cylinder thereupon opens the closure element of a control valve so that pressurised fluid streams to the pressure space of the auxiliary support cylinder. This cylinder is constructed in the same way as the advancing cylinder. During extension of the auxiliary support cylinder, a control fluid contained in the annular space as a column of liquid is also expelled into a second control cylinder by its piston rod. A switching piston in this cylinder returns the closure element of the control valve into a closed position, thus interrupting the further outward movement of the auxiliary support cylinder until the control mechanism is again actuated when the advancing cylinder moves further. However, this control mechanism requires complicated switchgear for the control valve and an auxiliary support cylinder of special construction whose size makes it difficult to be accommodated in an auxiliary support canopy.

According to a further proposal described in Glückauf, 114, 1978, No. 15, P. 641 and German Specification No. 29 17 609, an auxiliary support cylinder is caused to extend in steps, by mechanical control, in dependence on the longitudinal extension of the advancing cylinder. To this end there is provided a control valve with a spring-loaded switching lever which, during extension of the advancing cylinder, rides over control cams fitted to the cylinder jacket. When a control cam is ridden over, the switching valve opens and pressurised fluid streams from the high pressure line under the piston surface of a metering cylinder, causing the liquid in a metering space (which has previously been sucked in from the return flow line) to be expelled into the displacement space of the auxiliary support cylinder. The auxiliary support canopy now moves some distance towards the working face. Closure of the control valve occurs when the switching lever dips into a depression between two control cams. Thereupon pressurised fluid acts on the annular surface of the metering piston, causing the piston to return to its starting position and the metering space being refilled with fluid from the return flow line. The auxiliary support cylinder is thereby extended in steps at intervals of time, by mechanical control means, to reach the longitudinal extension of the advancing cylinder. However, control of the auxiliary support cylinder can be impaired by dust or dirt collecting in the depressions between the control cams of the advancing cylinder. In addition, the exposed scanning elements can obstract the driving track.

With the above-mentioned control mechanism, the synchronous movement is performed in one direction only. To avoid roof falls, the aim should however be to obtain a synchronous retraction of the forward auxiliary support canopy as well as a synchronous extending movement so that the auxiliary support canopy does not become detached from the roof during the advancing movement.

The present invention is directed to the aim of providing a control mechanism for the synchronous movement of the auxiliary support canopy and the advancing cylinder which involves simple technical means, which gives an automatic synchronisation in either direction, and which responds to every change in movement without delay.

With this aim in view, control mechanism according to the invention is arranged to control the synchronous movement of the auxiliary roof-support cylinder mounted in the auxiliary support canopy and the advancing cylinder in dependence on the pressure in a control line connecting the cylinder displacement space of a measuring cylinder with a volume variable commensurately with the longitudinal extension of the advancing cylinder or a corresponding measuring bore to the annular space of the auxiliary support cylinder. The increase in volume which occurs during the advancing movement of the mine-roof support produces a drop in pressure in the measuring cylinder and in the control line, thereby causing the opening of a 3-port, 2-position, directional control valve via which pressurised fluid streams from the high pressure line into the auxiliary support cylinder pressure space and extending the auxiliary support canopy. The pressurised fluid expelled from the annular space of the auxiliary support cylinder flows into the displacement volume space of the measuring cylinder via the control line. As soon as this space stops enlarging when the advancing cylinder comes to a halt, the pressure in the control line and the measuring cylinder or the measuring bore again increases causing the control valve to be closed and the auxiliary support canopy to stop extending further.

The control mechanism according to the invention controls the synchronous movement of the auxiliary support assembly and the extension of the advancing cylinder both in the forward direction during moving of the conveyor adjacent the working face and also in the rearward direction during advancing movement of the mine-roof support. It does this automatically and substantially simultaneously so that faulty operation is avoided. The precise response of the control mechanism allows the mine-roof support to be moved with the auxiliary roof-support canopy pressed firmly against the roof. If the forward-moving auxiliary roof-support canopy meets an obstacle it stops, causing the measuring cylinder of the advancing cylinder, which continues to move forwards, to be filled with pressurised fluid from an equalisation chamber, thereby preventing voids from being sucked into the control line.

Simple technical means are used to perform the controlling function according to the invention. The control mechanism required is small in size and is composed of series-produced components. An axial bore is provided in the piston rod of the advancing cylinder as the measuring cylinder to provide an advantageous space-saving mode of construction. As a result, the control mechanism can be readily accommodated in mine-roof supports for shallow seams.

Examples of hydraulic control mechanism according to the invention are illustrated in the accompanying drawings, in which FIG. 1 is a circuit diagram of a simple form of synchronisation control mechanism;

Figure 1:
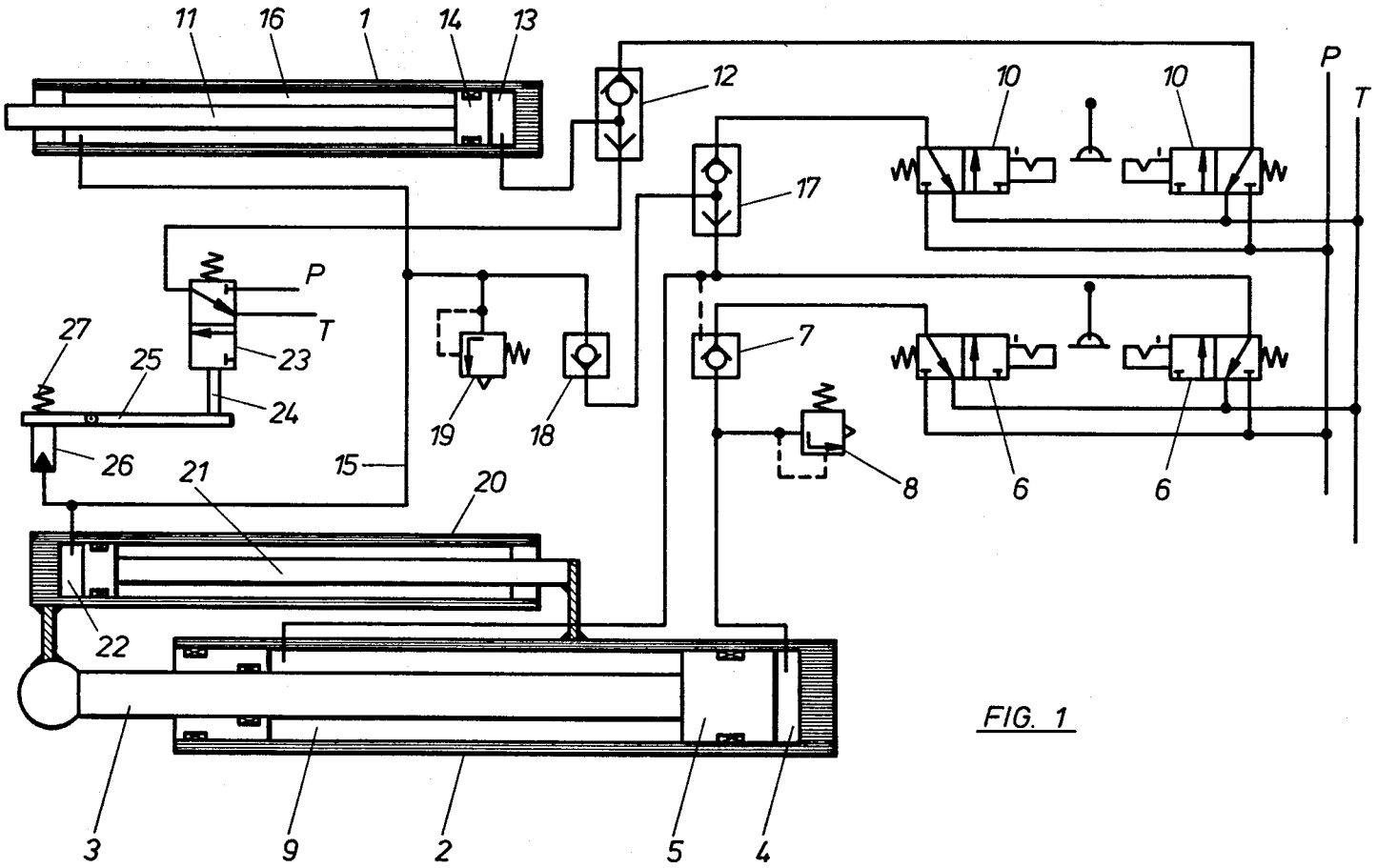
Figure 4:
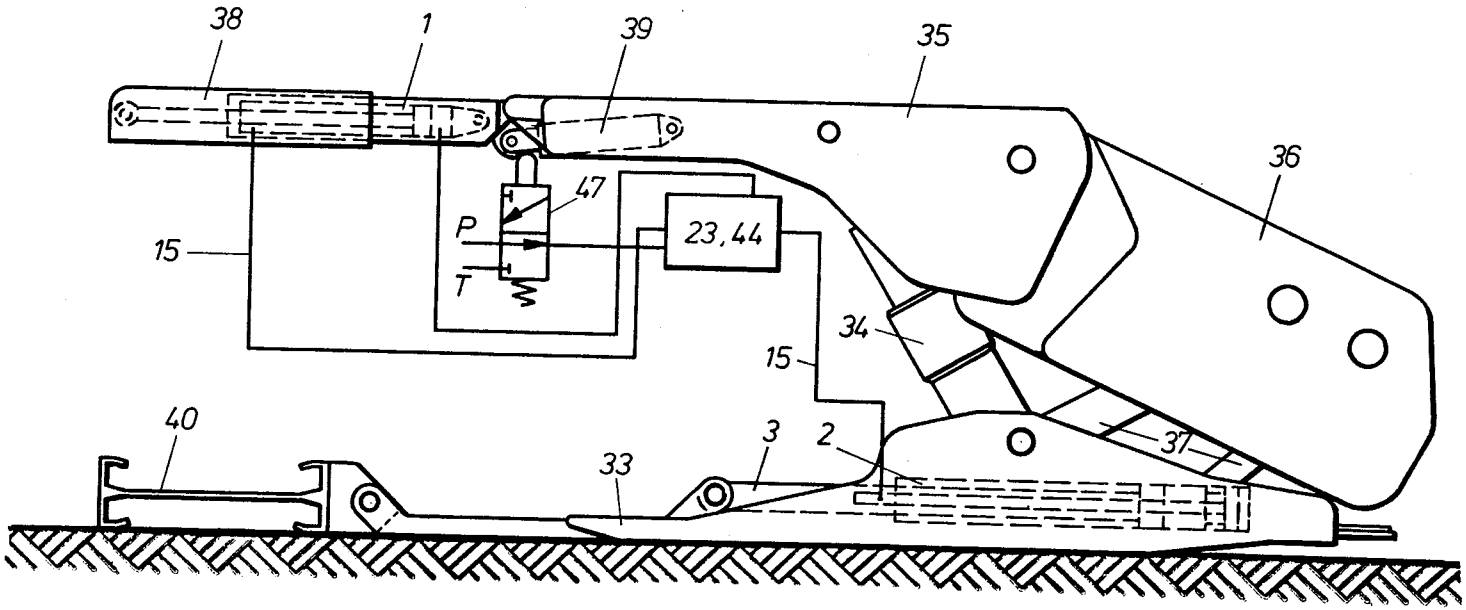
FIG. 4 is a side view of an hydraulically-advancing mine-roof support incorporating the synchronisation control mechanism.

The hydraulic control mechanism shown in FIG. 1 serves for the synchronisation of an auxiliary roof-support cylinder 1 and an advancing cylinder 2 in an hydraulically-advancing mine-roof support of the construction shown in FIG. 4. The mine-roof support comprises a base structure 33 having vertically-adjustable hydraulic props 34 mounted thereon which support a main roof-support canopy 35. A rockfall shield 36 is pivotally mounted on the base structure 33 by means of rocker arms 37 and is pivoted to the rear portion of the main roof support canopy 35. On the working face side of the support there is a telescopically-extensible auxiliary support canopy 38 which can be extended in the direction of the working face by the auxiliary cylinder 1 mounted therein. The auxiliary support canopy 38 is pivotally connected to the main roof support canopy 35 by an articulated joint and is pivotable up and down by means of an hydraulic jack or ram 39. The advancing cylinder 2 of the mine-roof support is mounted on the base structure 33 and is held in contact against the conveyor 40 extending alongside the working face of an abutment.

After winning of the coal or other mineral at the working face, the conveyor 40 is pushed forwards by the extending piston rod 3 of the advancing cylinder 2 in correspondence with the exploitation achieved at the working face. To this end, the pressure space 4 to the rear of the piston 5 of the advancing cylinder 2 is pressurised by one of the two 2-position, 3-port, directional control valves of a drive valve assembly 6 with pressurised fluid from a high pressure line P. The feedline to the pressure space 4 of the advancing cylinder 2 contains a check valve 7 and a pressure limiting valve 8. To cause the piston rod 3 to be retracted during the advancing movement of the mine-roof support, the annular space 9 of the advancing cylinder 2 is pressurised with pressure fluid via the second 2-position, 3-port, directional valve in the drive valve assembly 6.

In the simple synchronous movement control mechanism illustrated in FIG. 1, only one auxiliary roof-support cylinder 1 is provided, and this is controlled by a drive valve assembly 10 comprising two 2-position, 3-port, directional control valves. To cause the piston rod 11 of the auxiliary roof-support cylinder 1 to extend in order to push the auxiliary roof-support canopy 38 forward, pressurised fluid is led from the high pressure line P into the pressure space 13 to the rear of the piston 14 via a two-way valve 12. To produce retraction, the annular space 16 of the auxiliary roof-support cylinder 1 is pressurised via a two-way valve 17 and a check valve 18, the annular space 16 being connected to a control line 15 which is made safe by means of a pressure-limiting valve 19.

In the embodiment according to FIG. 1, a "measuring" cylinder 20 of variable length is arranged parallel to the advancing cylinder 2 with its piston rod 21 coupled with the cylinder of the advancing cylinder 2 and its cylinder coupled with the piston rod 3 of the advancing cylinder 2. The displacement volume space 22 of the measuring cylinder 20 is connected to the annular space 16 of the auxiliary roof-support cylinder 1 via the control line 15.

To effect synchronous movement with the advancing cylinder 2, the pressure space 13 of the auxiliary roof-support cylinder 1 can be acted on, via a 2-position, 3-port, directional control valve 23, by pressurised fluid from the high pressure line P supplied in dependence on the pressure in the control line 15 via the two-way valve 12. The control valve 23, which has a closure element (not shown) held in the closed position by a spring, is opened by a push-rod switching element 24. This switching element is operated by an hydraulic balance arm 25 which, on one side, is acted on by a switching piston 26 connected to the control line 15 and, on the other side, is acted on by a spring 27. The area of the switching piston 26 and the force of the spring 27 are mutually matched in such a way that the switching piston 26 acted on by the pressure in the control line 15 holds the balance arm 25 in a position where it does not exert a force on the push rod switch against the force of the spring 27. Thus, the control valve 23 is closed and the pressure space 13 of the auxiliary support cylinder 1 is connected to the return flow line T when a certain set pressure obtains in the control line 15. As soon as the pressure falls below the set threshold value and the force acting on the switching piston 26 diminishes so much that the force of the spring 27 causes the balance arm 25 to move in the direction of the push rod 24, the control valve 23 opens to the high pressure line P. This is the case when the pressure space 4 of the advancing cylinder 2 is pressurised with pressurised fluid by the drive valve 6 and the piston rod 3 extends. As a result, the measuring cylinder 20 coupled with the piston rod 3 is caused to extend with respect to the fixed piston rod 21, thus causing the pressure in the control line 15 connected to the measuring cylinder 20 to fall as the displacement volume increases.

Pressurised fluid now flows through the opened control valve 23 from the high pressure line P via the two-way valve 12 into the pressure space 13 of the auxiliary roof-support cylinder 1 and pressurises the piston 14. During the outward stroke of the piston rod 11, pressurised fluid is forced out from the diminishing annular space 16 of the auxiliary roof-support cylinder into the control line 15 to the measuring cylinder 20. As the annular space 16 of the auxiliary roof-support cylinder 1 and the displacement space 22 of the measuring cylinder 20 have equal cross-sectional areas, the control valve 23 remains open for as long as the volume of liquid expelled from the annular space 16 is compensated for by the enlarging of the displacement volume 22 in the measuring cylinder 20 during the outward stroke of the piston rod 3 of the advancing cylinder 2. The auxiliary roof-support cylinder 1 and the advancing cylinder 2 are then extended synchronously by an equal amount. However, as soon as the displacement volume 22 of the measuring cylinder 20 ceases to increase further because the advancing cylinder 2 comes to a halt, the pressure in the control line 15 increases, thus causing the balance arm 25 to return to the starting position, in which the control valve 23 is closed, by virtue of the force acting on the switching piston 26.

Figure 2:
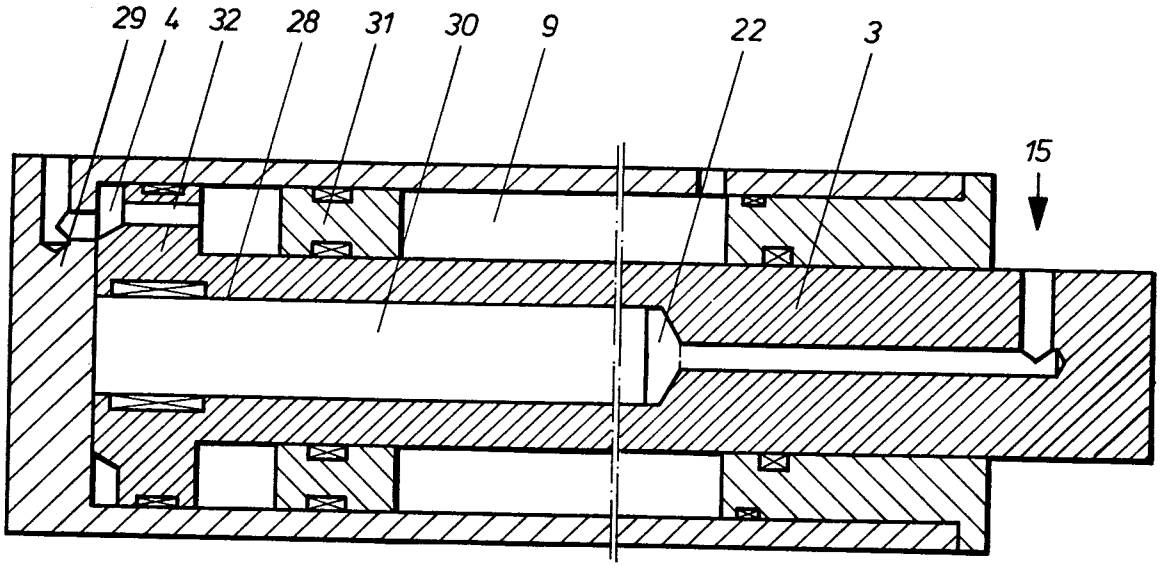
FIG. 2 shows an advancing cylinder for the synchronous movement control mechanism in longitudinal section.

In one advantageous construction in accordance with the invention, the measuring cylinder is integrated into the piston rod 3 of the advancing cylinder 2 as shown in FIG. 2. The displacement space 22 of the measuring cylinder 20 is here formed by the axial bore 28 in the piston rod 3 into which a plunger 30 secured to the cylinder bottom 29 extends. In this construction the piston 31 is no longer rigidly connected to the piston rod 3 but is mounted to be freely, axially-movable, thereon. To extend the piston rod 3, a collar 32 at the inner end of the piston rod 3 is subjected to pressurised fluid to cause the flexibly-supported piston 31 to move as well without being loaded. During retracting of the piston rod 3 for pulling the mini-roof support forwards, the piston 31 resting in contact against the collar 32 pushes the piston rod 3 back into the advancing cylinder 2.

Figure 3:
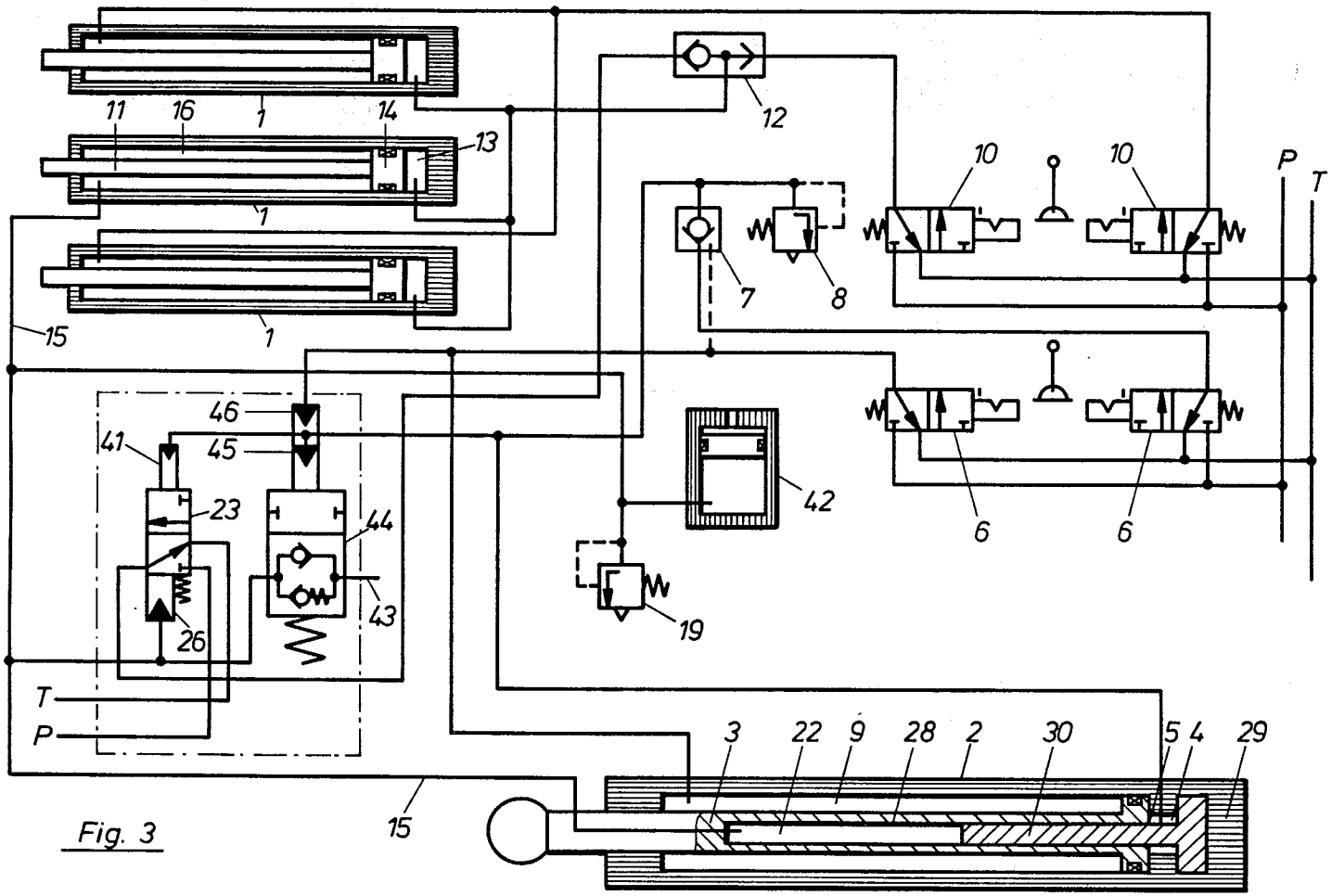
FIG. 3 shows a further-developed form of the circuit diagram of the synchronisation control mechanism.

In the modified arrangement according to FIG. 3, a switching piston 41 is provided in place of the spring 27 switching the 3-port, 2-position, directional valve 23 into the open position when the pressure falls in the control line. This piston 41 can be pressurised with pressurised fluid supplied by the drive valve assembly 6 to the pressure space 5 of the advancing cylinder 2. Three auxiliary roof-support cylinders 1 are arranged in the auxiliary roof-support canopy 38 (not shown in FIG. 3) of which the middle one is connected to the control line 15 with the annular space 16 and is also connected to the switching piston 26 of the 3-port, 2-position, directional valve 23 and the measuring bore 28 of the advancing cylinder 2. The switching piston 26 in the direction of closure acts in the same direction as the closure spring of the 3-port, 2-position, valve 23 and has a larger piston area than the switching piston 41 connected to the pressure space 4 of the advancing cylinder 2 opening the directional valve 23 to the connected high pressure line P. Further, an equalisation chamber or vessel 42 with a filled volume equal to that of the measuring bore 28 is connected to the control line 15.

From a setting valve (not illustrated) for the prop 34, a line 43 leads to a control valve 44 which is connected to the control line 15. In this way pressurised fluid can flow into the setting line 15 and the equalisation chamber or vessel 42 and fill the control line 15 with pressurised fluid during each setting operation. The control valve 44 is constructed in such a way that it adjusts the pressure in the control line 15 automatically to a pre-set threshold value. The pressure fluid entering during the setting operation also pressurises the annular space 16 in front of the piston 14 of the auxiliary roof-support cylinder 1 so that the possibly still partly-extended forward auxiliary roof canopy 38 is entirely retracted.

The control valve 44 closes the control line 15 with respect to the line 43 as soon as pressurised fluid pressurises one of its two series-connected switching pistons 45 and 46. The pressurized fluid is supplied by the drive valve assembly 6 to one or the other piston side of the advancing cylinder 2. This ensures that the control line 15 is closed to the outside at each actuation of the advancing cylinder 2. The supply of pressurised fluid from the high pressure line P to the 2-position, 3-port, directional control valve 23 can be interrupted by a shut-off valve 47 arranged between the main roof-support canopy 35 and the auxiliary roof-support canopy 38 if the angle of inclination of the auxiliary roof-support canopy exceeds a certain pre-set value.

Functioning of the synchronous movement control mechanism of FIG. 3 proceeds as follows:

To extend the piston rod 3, the pressure space 4 of the advancing cylinder 2 is pressurised with pressurised fluid from the high pressure line P through the drive valve assembly 6. The entering pressurised fluid at the same time acts on the switching piston 41 of the 3-port, 2-position, directional control valve 23 and on the switching piston 45 of the control valve 44. Extending of the piston rod 3 of the advancing cylinder 2 enlarges the displacement volume space 22 of the measuring bore 28 serving as a measuring cylinder. As a result, the pressure in the control line 15 acting on the operating piston 26 falls below the pre-set threshold value. The switching piston 41 now shifts the 3-port, 2-position, directional valve 23 into the open position in which pressurised fluid streams from the high pressure line P into the pressure spaces 13 of the auxiliary roof-support cylinders 1 via the two-way valve 12. The pressure acting on the piston 14 causes the auxiliary roof-support canopy 38 to extend with the piston rods 11. While the pressurised fluid displaced from the annular spaces 16 of the two outer auxiliary support cylinders 1 flows away via the drive valve 10 open to the return flow line T, pressurised fluid is expelled from the annular space 16 of the middle auxiliary support cylinder 1 via the control line 15 into the displacement space 22 of the measuring bore 28 which increases in size during extending of the advancing cylinder 2. The volumes equalise during this process. When the advancing cylinder 2 comes to a halt, the pressure in the control line 15 increases immediately and, by means of the switching piston 26, switches the supply of pressure fluid from the high pressure line P via the 2-position, 3-port, directional control valve 23 to the pressure space 13 of the auxiliary roof-support cylinder 1. Conversely, the measuring fluid is expelled from the displacement space 22 of the measuring bore 28 as working fluid into the annular space 16 of the middle auxiliary roof-support cylinder 1 during retracting of the advancing cylinder 2. The middle cylinder is now retracted synchronously with the advancing cylinder 2, pressure fluid being expelled into the return flow line T from the pressure spaces 4 and 13.

We claim:

1. An hydraulically-movable mine-roof support comprising an hydraulic advancing cylinder which is pressurised on both sides of a piston therein with pressurised fluid by a drive valve, the advancing cylinder being held in a base structure of the mine-roof support, a plurality of hydraulic, vertically-adjustable, props supported on said base structure for supporting a main roof-support canopy provided with a forward, auxiliary, roof-support canopy pivoted thereto and extensible in the direction of the working face in synchronism with longitudinal extension of the advancing cylinder by an auxiliary roof-support cylinder pressurisable on both sides of a piston therein with pressurised fluid, the said synchronous movement being controlled by a control valve communicating with the advancing cylinder via a control line, wherein:

(a) a measuring cylinder having a space of variable volume extends substantially parallel to the extensible length of the advancing cylinder and is connected to an annular space in the auxiliary roof-support cylinder by a control line; and (b) a 2-position, 3-port, directional control valve which supplies pressurised fluid from a high pressure line to a pressure space of the auxiliary roof-support cylinder has a closure element spring-loaded in the direction of closure and is controllable by the pressure in the control line in such a way that the 2-position, 3-port, directional control valve is opened when the pressure falls below a pre-set threshold value and is closed when the pressure rises above the threshold value.

2. A mine-roof support according to claim 1, wherein a push-rod switch of the control valve is put under load by an initially tensioned spring in order to actuate the closure element in the direction of opening against a switching piston pressurised by the pressure in the control line, with the spring and the switching piston engaging an hydraulic balance arm in mutually opposite directions.

3. A mine-roof support according to claim 1, wherein the 2-position, 3-port, directional control valve is arranged to be acted on in the direction of opening by a switching piston pressurisable with the pressurised fluid led from the drive valve to the pressure space of the advancing cylinder and, in the direction of closure, is put under load on a switching piston of larger piston area by the pressure in the control line.

4. A mine-roof support according to claim 1, wherein the displacement space of the measuring cylinder and the annular space of the auxiliary roof-support cylinder have substantially equal cross-sectional areas.

5. A mine-roof support according to claim 1, wherein a fluid equalisation chamber the volume of which corresponds to that of the measuring cylinder is connected to the control line.

6. A mine-roof support according to claim 1, wherein a control valve for adjusting the pressure to the preset threshold value is connected to the control line.

7. A mine-roof support according to claim 6, wherein the control line can be pressurised via the control valve during the setting operation with the pressurised fluid that is led to the props of the mine-roof support.

8. A mine-roof support according to claim 1, wherein the control valve can be pressurised in the direction of closure by the pressure fluid led from the drive valve to the annular space of the advancing cylinder.

9. A mine-roof support according to claim 1, wherein the control valve is arranged ti be pressurized in the direction of closure by a second switching piston with pressurised fluid led from the drive valve to the pressure space of the advancing cylinder.

10. A mine-roof support according to claim 1, wherein the control fluid displaced from the displacement space of the measuring cylinder during advance of the mine-roof support forms the working fluid streaming into the annular space of the auxiliary cylinder.

11. A mine-roof support according to claim 1, wherein the supply of pressurised fluid from the high pressure line to the 2-position, 3-port, directional control valve is controlled by a shut-off valve in dependence on the angle between the auxiliary roof-support canopy and the main roof-support canopy.

12. A mine-roof support according to claim 1, wherein an axial bore is provided in the piston rod of the advancing cylinder to serve as the measuring cylinder, there being a plunger in the bore which is secured to an end portion of the advancing cylinder.

13. A mine-roof support according to claim 1, wherein a piston is mounted in the advancing cylinder so as to be freely movable along the piston rod and, for retraction, rests against a collar at the internal end of the piston rod.

14. A mine-roof support according to claim 1, wherein three auxiliary roof-support cylinders are juxtaposed substantially parallel to one another in the auxiliary roof-support canopy, one of the said cylinders being connected to the control line through its annular space, while the other two cylinders are arranged to be independently pressurised in their annular spaces by the drive valve with pressurised fluid from the high pressure line.

* * * * *